US008075061B2

(12) United States Patent
Ko

(10) Patent No.: US 8,075,061 B2
(45) Date of Patent: Dec. 13, 2011

(54) BEARING MECHANISM WITH INTEGRATED FLEXIBLE BEARING SURFACE

(76) Inventor: Wen-Shan Ko, Tainan County (TW)

( * ) Notice: Subject to any disclaimer, the term of this patent is extended or adjusted under 35 U.S.C. 154(b) by 207 days.

(21) Appl. No.: 12/509,462

(22) Filed: Jul. 25, 2009

(65) Prior Publication Data

US 2011/0018328 A1 Jan. 27, 2011

(51) Int. Cl.
*A47C 7/02* (2006.01)

(52) U.S. Cl. ..... 297/452.56

(58) Field of Classification Search ..... 297/452.56, 297/452.21, 452.57, 452.63, 440.11, 452.18
See application file for complete search history.

(56) References Cited

U.S. PATENT DOCUMENTS

| | | | | |
|---|---|---|---|---|
| 3,088,517 | A * | 5/1963 | Schwartz et al. | 160/184 |
| 6,102,482 | A * | 8/2000 | Dettoni et al. | 297/452.56 |
| 6,899,398 | B2 * | 5/2005 | Coffield | 297/452.56 |
| 7,066,553 | B2 * | 6/2006 | Maloney | 297/452.63 |
| 2007/0267911 | A1 * | 11/2007 | Kinoshita et al. | 297/452.18 |

* cited by examiner

*Primary Examiner* — Milton Nelson, Jr.
(74) *Attorney, Agent, or Firm* — Egbert Law Offices PLLC

(57) ABSTRACT

The present invention provides a bearing mechanism with an integrated flexible bearing surface. The bearing mechanism includes a frame, which is folded to define an inner space; and an integrated flexible bearing surface, which has an elastic restoring force and is prefabricated onto the inner space of the frame. At least two sides of the integrated flexible bearing surface are mated integrally with the frame when the bearing mechanism is fabricated. The present invention enhances the structural strength, reduces greatly the fabrication cost and improves substantially the manufacturing efficiency with better applicability and industrial benefits.

9 Claims, 6 Drawing Sheets

BEARING MECHANISM WITH INTEGRATED FLEXIBLE BEARING SURFACE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a bearing mechanism, and more particularly to an innovative bearing mechanism with a seat back or seat cushion for the users.

2. Description of Related Art Including Information Disclosed Under 37 CFR 1.97 and 37 CFR 1.98

Many people spend a lot of time sitting on chairs, so the comfort of sitting and the backing is very crucial, affecting the direction of new product development.

A bearing mechanism made of elastic strips or elastic bands, or a bearing mechanism composed of mesh and framing strips is currently available so as to improve the existing shortcomings of a seat back and seat cushion of chairs, such as rigidity and poor air permeability. However, it is found from actual application that, as for a bearing mechanism made of elastic strips or elastic bands, the assembly end of the unit elastic strip (band) must be linked securely to the assembly seat, which is then incorporated onto a frame by means of screwing or riveting. The single frame must be fitted with several assembly seats and elastic strips, leading to several assembly processes, higher fabrication cost and poorer fabrication efficiency as well as unsatisfactory structural strength and durability. As for the other bearing mechanism composed of mesh and framing strips, the mesh is generally tightened and then positioned onto an interior frame, which is then incorporated onto an external frame by means of embedding, screwing and adhesion, leading similarly to higher fabrication cost, poorer fabrication efficiency and unsatisfactory durability.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

There is enhanced efficacy of the present invention.

Based on the unique present invention, a bearing mechanism is formed by combination of the frame with the integrated flexible bearing surface. The present invention avoids complex assembly and a positioning process, thus reducing greatly the fabrication cost and improving substantially the manufacturing efficiency with better applicability and industrial benefits.

Also, as the frame is combined integrally with the integrated flexible bearing surface without assembly portions between them, it is possible to enhance the structural strength and durability of the bearing mechanism and extend its service life.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1A:
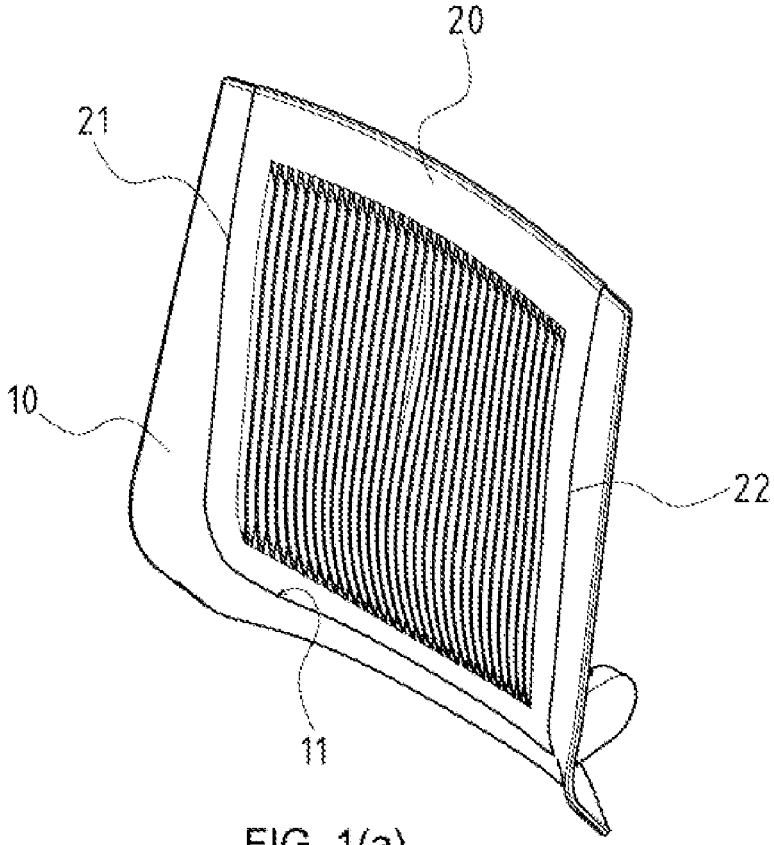
FIG. 1 shows a schematic view of the preferred embodiment of the frame of the present invention.
Figure 1B:
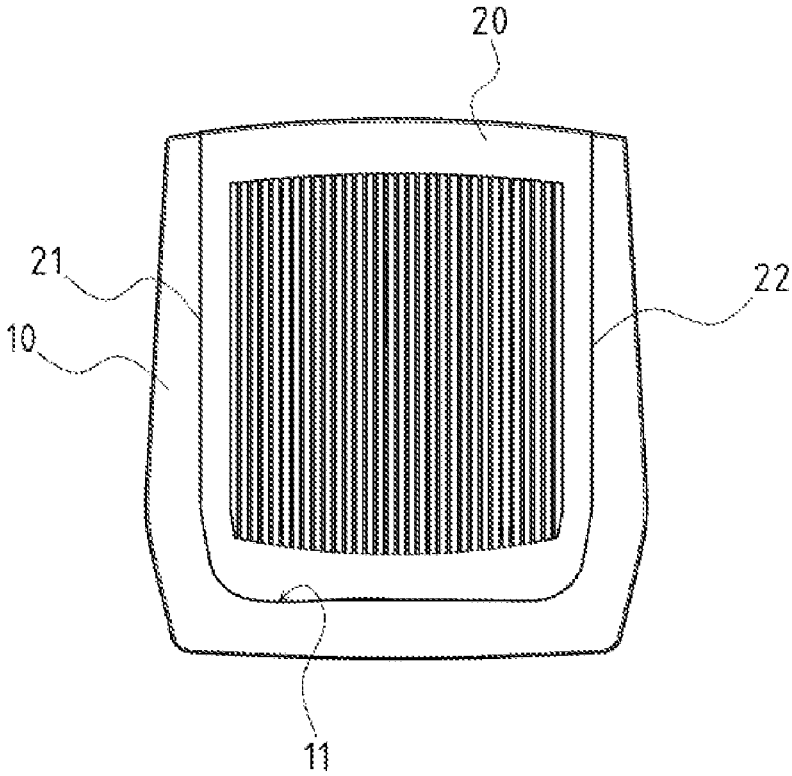

FIGS. 1(*a*) and 1(*b*) shows respective perspective and frontal views of a preferred embodiment of the frame of the bearing mechanism of the present invention.

Figure 2:
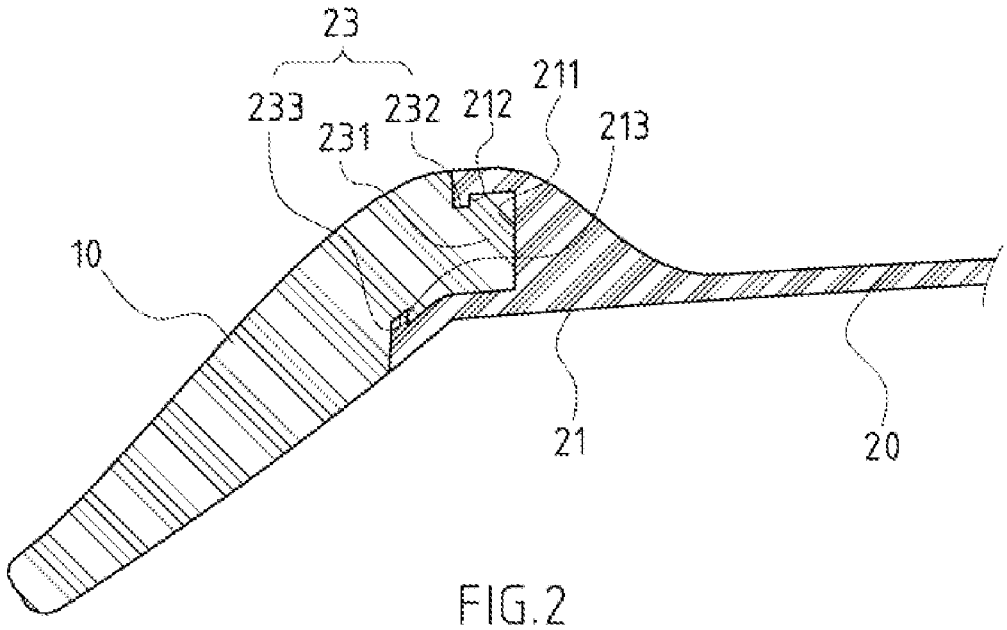
FIG. 2 shows a local sectional view of the preferred embodiment of the present invention.

FIG. 2 is a plan view of one embodiment of the embedding portion of the present invention.

Figure 3:
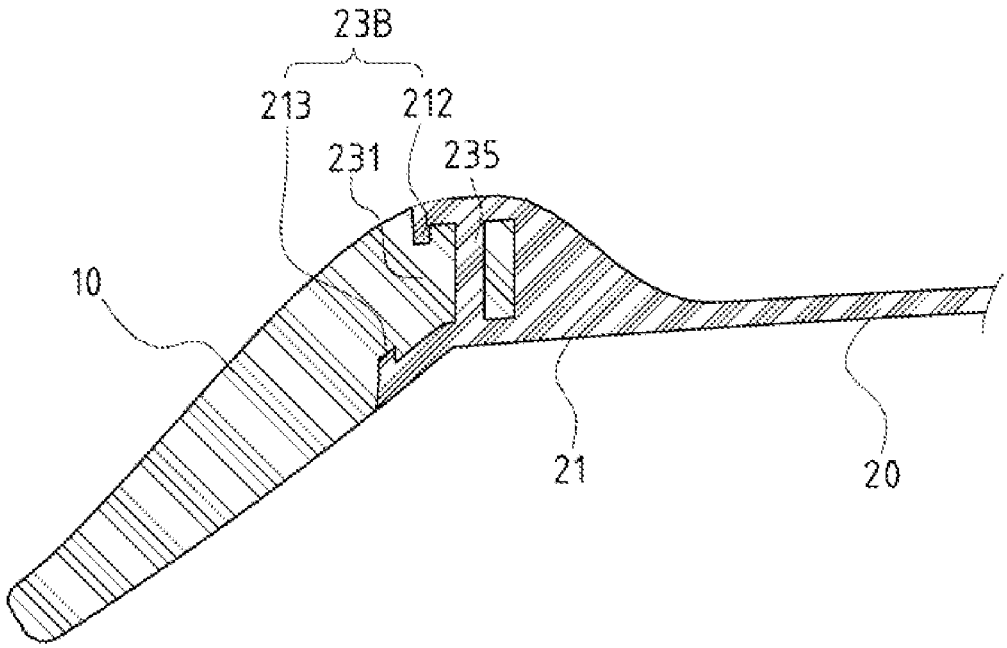
FIG. 3 shows a local sectional view of another preferred embodiment of the present invention.

FIG. 3 is a plan view of another embodiment of the embedding portion of the present invention.

Figure 4:
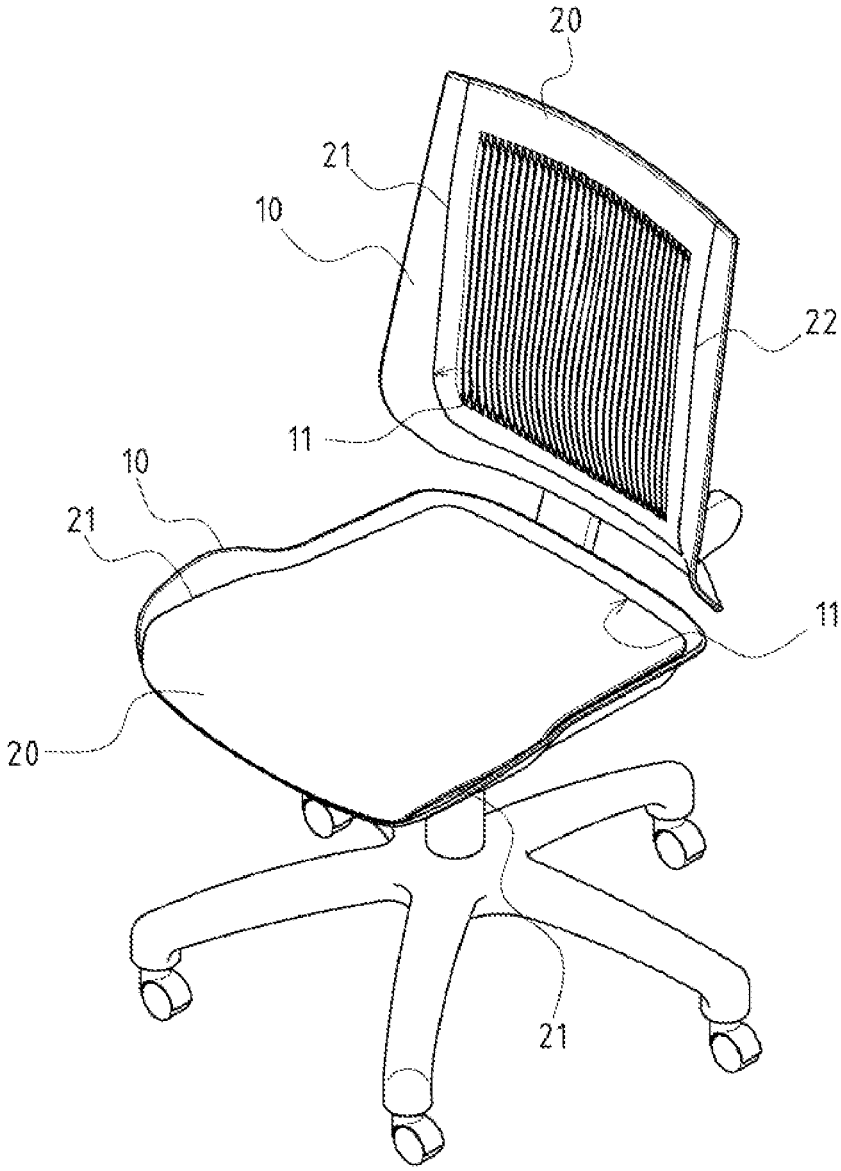
FIG. 4 shows a perspective view of an application of the present invention.

FIG. 4 is an upper perspective view of the bearing mechanism of the present invention as applied to a chair.

Figure 5C:
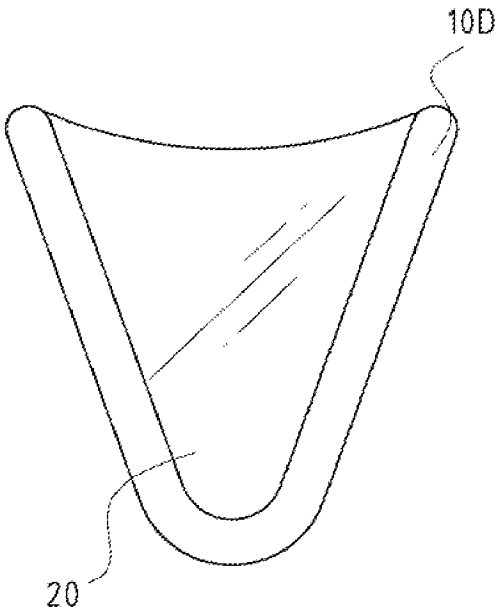
FIG. 5 shows sectional views of variations of the frame of the present invention.
Figure 5B:
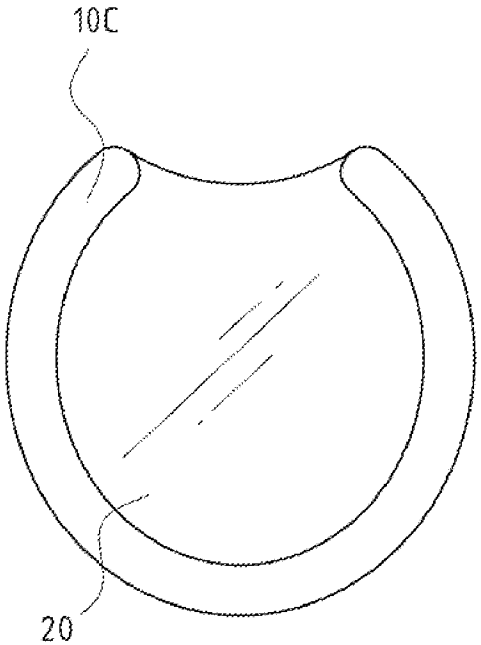
Figure 5A:
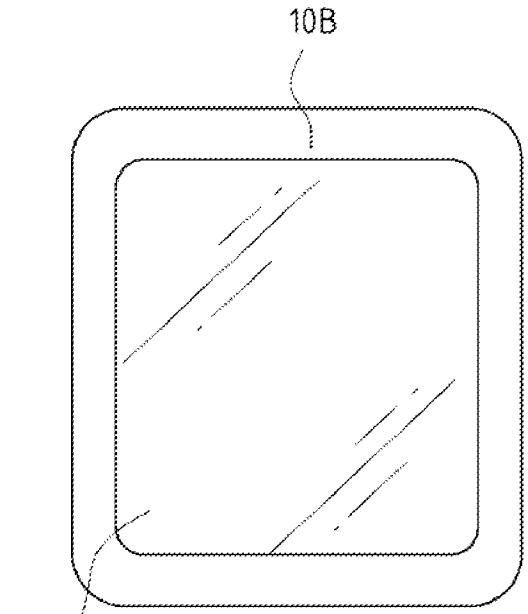

FIGS. 5(*a*), 5(*b*), 5(*c*), shows respectively a mouth-shaped frame, a C-shaped frame and a V-shaped frame of the bearing mechanism of the present invention.

Figure 6:
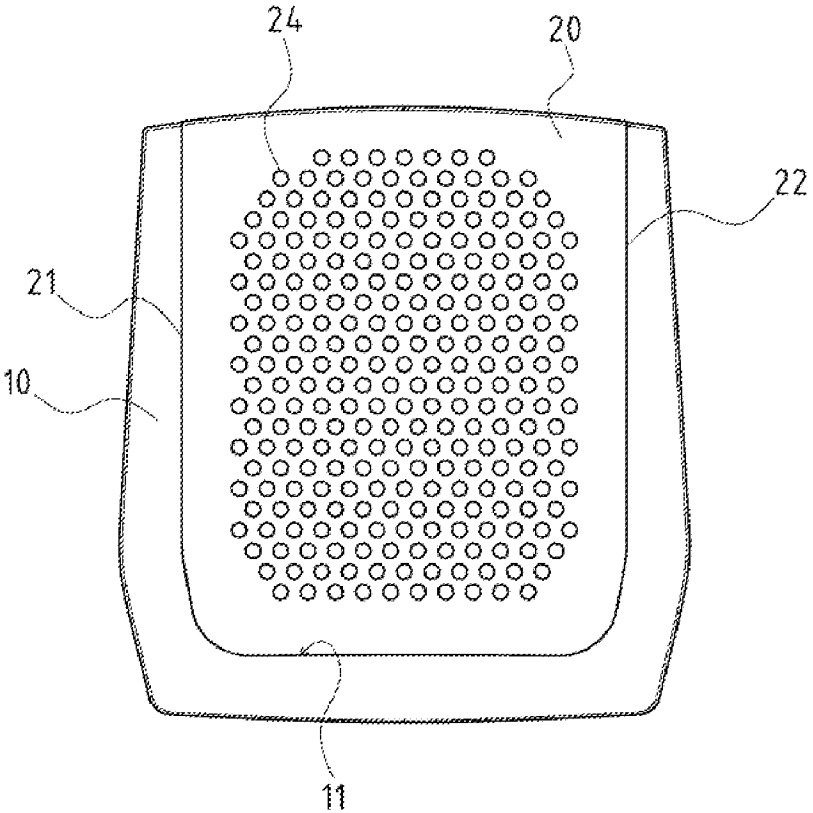
FIG. 6 shows an elevation view of an application of the present invention, showing the integrated flexible bearing surface provided with penetrating portions.

FIG. 6 is a frontal view of the bearing surface of the present invention.

Figure 7:
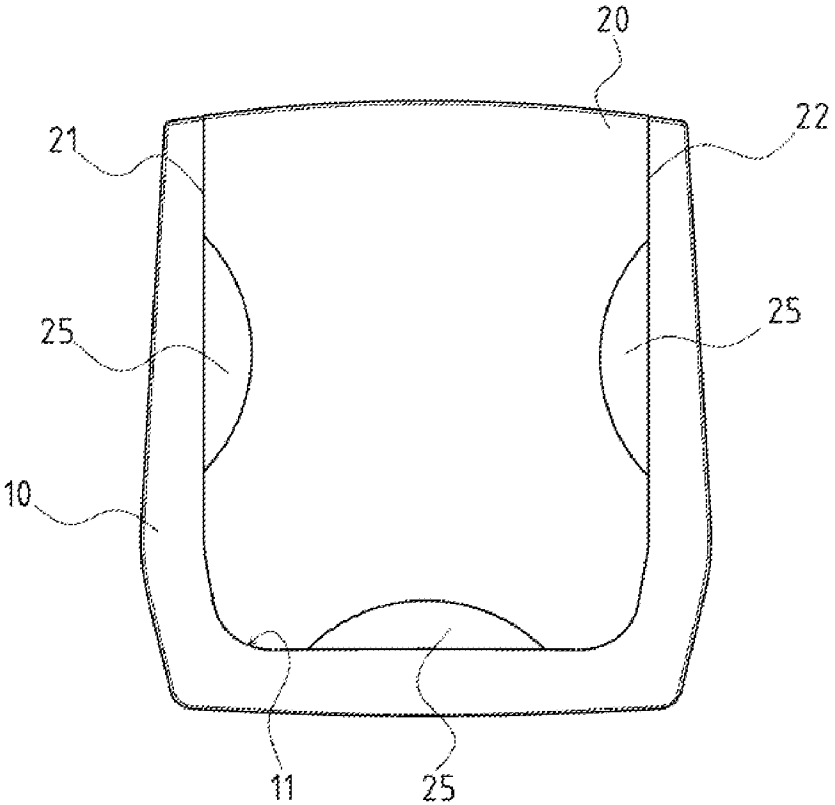
FIG. 7 shows an elevation view of an application of the present invention showing a permeable section formed laterally on the integrated flexible bearing surface.

FIG. 7 shows a frontal view permeable section of the bearing surface of the present invention.

Figure 8:
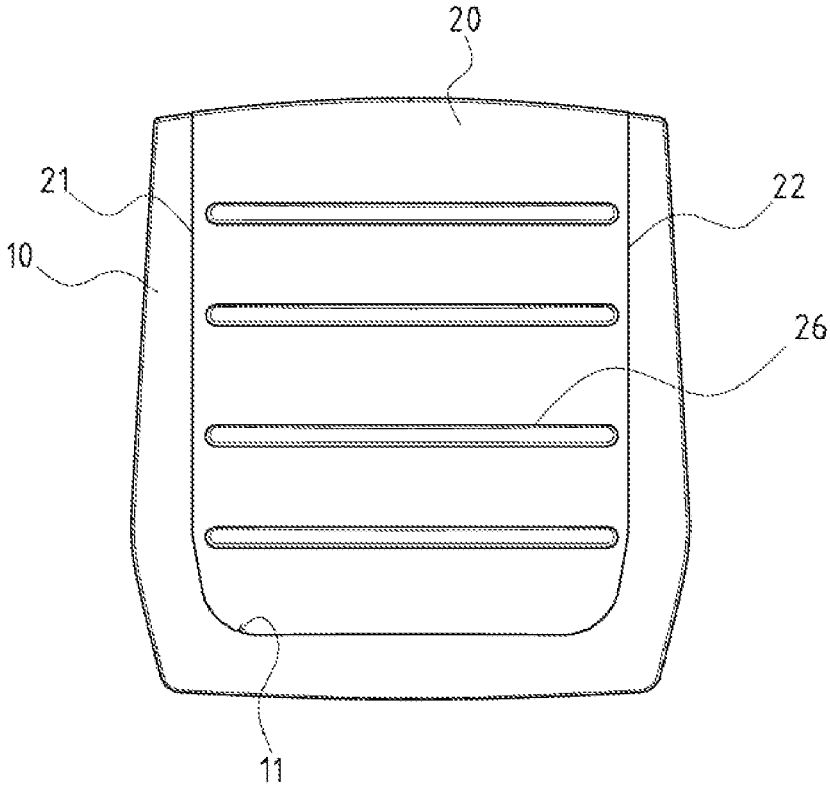
FIG. 8 shows an elevation view of an application of the present invention showing the integrated flexible bearing surface provided with convex texture.

FIG. 8 shows a frontal view of the ribbed structure as applied to the bearing surface of the present invention.

Figure 9:
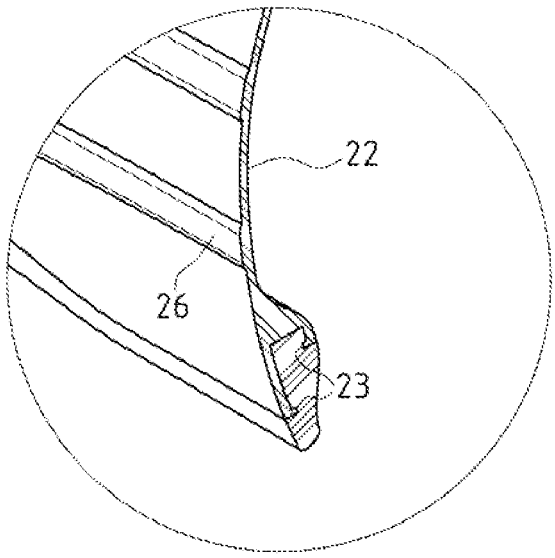
FIG. 9 shows a local sectional view of the present invention showing the integrated flexible bearing surface provided with convex texture.

FIG. 9 is a side perspective view of the embedding portions formed on the baring surface.

The bearing mechanism comprises a frame 10, which is folded to define an inner space 11.

The bearing mechanism comprises an integrated flexible bearing surface 20, which has elastic restoring force and is prefabricated onto the inner space 11 of the frame 10. Moreover, at least two sides 21, 22 of the integrated flexible bearing surface 20 are mated integrally with the frame 10 when the bearing mechanism is fabricated.

Said frame can be designed into several patterns, e.g. a Ц-shaped frame 10 as shown in FIG. 1(*a*), (*b*); or a mouth-shaped frame 10B as shown in FIG. 5(*a*); or a C-shaped frame 10C as shown in FIG. 5(*b*); or a V-shaped frame 10D as shown in FIG. 5(*c*).

The frame 10 is provided with an embedding portion 23 for embedding into the sides 21, 22 of the integrated flexible bearing surface 20. The embedding portion 23 is available with several patterns, e.g. the embedding portion 23 (shown in FIG. 2) comprises a flange 231 of concave profile formed inside the frame 10, and a first groove 232 and a second groove 233 formed correspondingly at both sides of the flange 231. Thus, a recessed portion 211 of stretched profile is formed at the side 21 of the integrated flexible bearing surface 20 for mating with the aforementioned flange 231. Furthermore, a first snapping portion 212 is formed on the surface of the side 21 of the integrated flexible bearing surface 20 for mating with the aforementioned first groove 232, whilst a second snapping portion 213 is formed on the other surface of the side 21 of the integrated flexible bearing surface 20 for mating with the aforementioned second groove 233, thereby serving for the embedding of the embedding portion 23. Referring also to FIG. 3, the embedding portion 23B comprises a flange 231, which is formed inside the frame 10, and provided with a through-hole 235. So, the interiors of the first snapping portion 212 and the second snapping portion 213 formed on the side 21 of the integrated flexible bearing surface 20 can be embedded into the through-hole 235 for more secure embedding.

Since the side 21 of the integrated flexible bearing surface 20 is mated with the frame 10 when the bearing mechanism is fabricated, the embedding portions 23, 23B can be formed through jet molding of the molds.

Referring to FIG. 6, penetrating portions 24 are formed on the integrated flexible bearing surface 20, and used as air holes, or used for decoration purpose due to the designed patterns.

Referring to FIG. 7, a permeable section 25 can be formed at the sides 21, 22 at the joint of the integrated flexible bearing surface 20 and the frame 10. The permeable section 25 can be used as air holes, or used for decoration purpose due to its boundary profile design.

Referring to FIGS. 8 and 9, convex textures 26 can be formed on the integrated flexible bearing surface 20 and used as a decorative pattern, or used to strengthen the ribbed structure for improving the structural strength of the integrated flexible bearing surface 20.

In practice, the bearing mechanism can be used as the seat back and/or cushion of the chair 30, thereby serving for backing and/or sitting purpose for the benefit of the users.

I claim:

1. A bearing mechanism comprising:

a frame being folded to define an inner space, said frame having an embedding portion; and an integrated flexible bearing surface having an elastic restoring force and positioned onto said inner space of said frame, at least two sides of said bearing surface being mated integrally with said frame, said embedding portion having a flange formed inside of said frame, said flange having a first groove and a second groove formed respectively at opposite sides of said flange, said bearing surface having a recessed portion at a side thereof so as to mate with said flange, said bearing surface having a first snapping portion formed on a surface of a side of said bearing surface, said first snapping portion mated with said first groove, said bearing surface having a second snapping portion formed on another surface of said side of said bearing surface, said second snapping portion being mated with said second groove.

2. The bearing mechanism of claim 1, said frame being mouth-shaped.

3. The bearing mechanism of claim 1, said frame being II-shaped.

4. The bearing mechanism of claim 1, said frame being V-shaped.

5. The bearing mechanism of claim 1, said frame being C-shaped.

6. The bearing mechanism of claim 1,said flange having a through-hole, said first and second snapping portions being embedded into said through-hole.

7. The bearing mechanism of claim 1, said bearing surface having a penetrating portion formed thereon.

8. The bearing mechanism of claim 1, further comprising:

a permeable section formed at a junction of said bearing surface and said frame.

9. The bearing mechanism of claim 1, said bearing surface having convex textures formed thereon.

* * * * *